US005358132A

United States Patent [19]

Bennett

[11] Patent Number: 5,358,132

[45] Date of Patent: Oct. 25, 1994

[54] CAP FOR CONTAINERS

[75] Inventor: Robert A. Bennett, Easton, Conn.

[73] Assignee: Bennett, Ambrogio and Conant, Stratford, Conn.

[21] Appl. No.: 200,730

[22] Filed: Feb. 23, 1994

[51] Int. Cl.[5] ..... B65D 51/18

[52] U.S. Cl. ..... 220/253; 222/559; 222/561; 220/346; 220/347

[58] Field of Search ..... 220/253, 254, 345, 346, 220/347; 222/559, 561

[56] References Cited

U.S. PATENT DOCUMENTS

| | | | |
|---|---|---|---|
| 3,409,189 | 11/1968 | McKeand, Jr. | 222/561 |
| 4,637,531 | 1/1987 | Olsson | 222/559 |
| 5,289,945 | 3/1994 | Stradder | 222/23 |

*Primary Examiner*—Allan N. Shoap
*Assistant Examiner*—Nova Stucker

[57] ABSTRACT

A cap adapted to be secured to an open end of a container employs a vertical hollow cylinder provided with an open lower end adapted to be secured to the open end of the container and a closed upper end with a small centrally disposed first opening therein surrounded by a raised peripheral first lip. The cylinder upper end has a second peripheral lip extending upwardly above the first lip, the second lip having first and second oppositely disposed cut out regions communicating with the cylinder upper end. A first horizontally elongated flexible member has first and second opposite ends each of which is aligned with the corresponding one of the first and second regions and is disposed between the first and second lips. The first member has a flat top surface and a downwardly depending extension which slidably engages the first lip. The extension in a horizontal plane defines a FIG. 8 with left hand and right hand sections. Each section has a hole of like shape and size as the first opening which extends upwardly through the member. One hole is sealed, the other hole being open. The first member is manually slidable between a closed position at which the one hole seals off the first opening and an open position at which the other hole is aligned with the first opening. A second flat horizontal member engages the second lip and is spaced above the first member. Tile second member has a second opening vertically aligned with the first opening.

5 Claims, 1 Drawing Sheet

FIG. 2
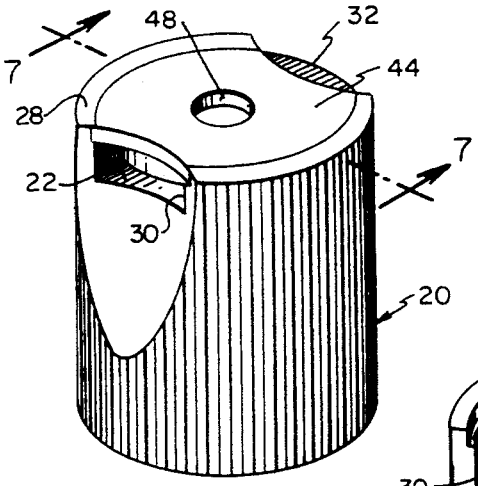
FIG. 1
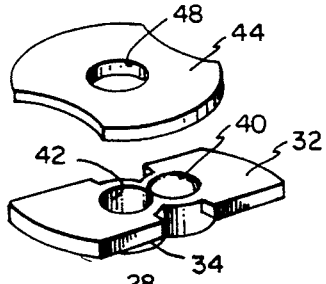
FIG. 5
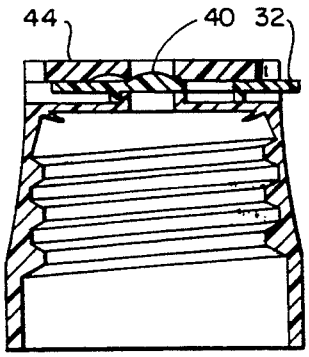
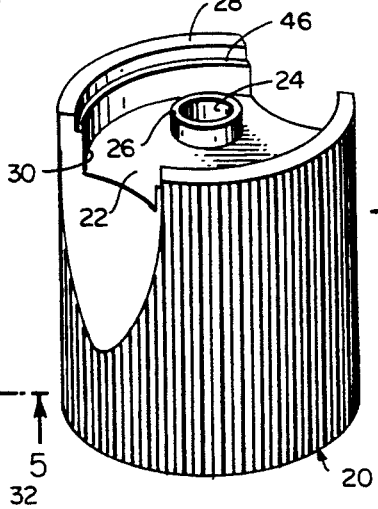
FIG. 8
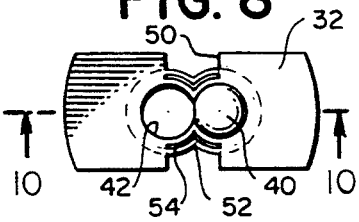
FIG. 3
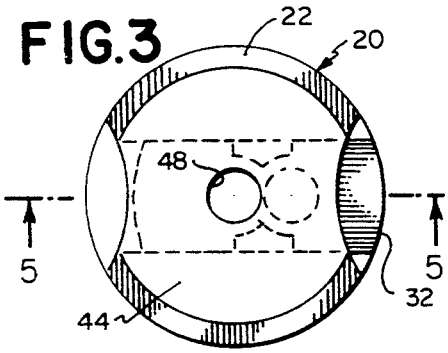
FIG. 4
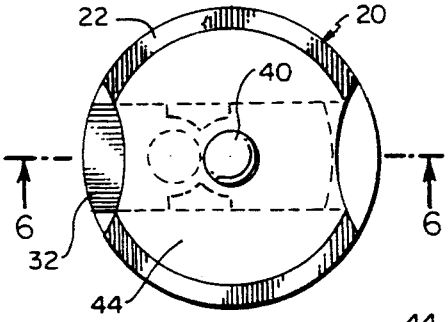
FIG. 7
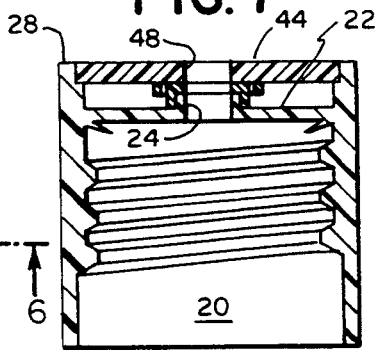
FIG. 9
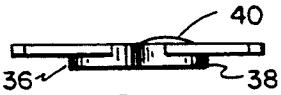
FIG. 10
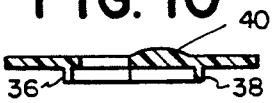
FIG. 11
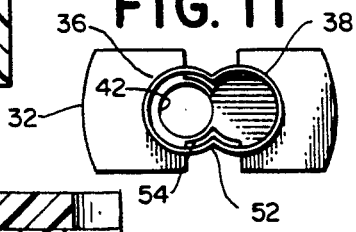
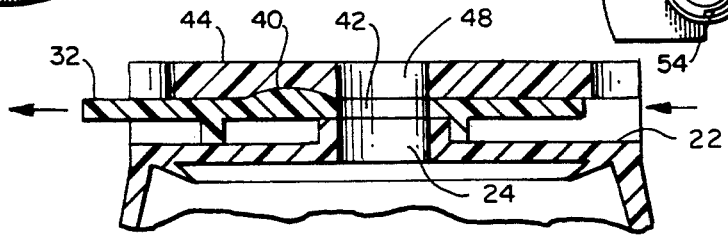
FIG. 6

CAP FOR CONTAINERS

BACKGROUND OF THE INVENTION

U.S. Pat. No. 5,199,617 discloses a cap for a container of material such as a liquid which can be secured to the container in sealed leak proof position. The cap, using a snap action, can be rotated in one direction to produce an opening through which the material can be removed and can be rotated in opposite direction to close the opening and seal off the contents of the container. The cap can remain in place during the entire period of use of the container or can be removed and replaced as desired.

However, this patented cap must be operated with the container held in one hand of the user while the cap is rotated in either desired direction using the other hand.

The present invention is directed toward a new type of cap which overcames this operational problem of the patented cap by employing a structure which can be operated, using a similar type of snap action, while held in one hand.

SUMMARY OF THE INVENTION

In accordance with the principles of this invention, a cap is :adapted to be secured to an open end of a container. The cap has a vertical hollow cylinder provided with an open lower end adapted to be secured to the open end of the container and a closed upper end with a small centrally disposed first opening therein surrounded by a raised peripheral first lip. The cylinder upper end has a second peripheral lip extending upwardly above the first lip. The second lip has first and second oppositely disposed cut out regions communicating with the cylinder upper end The cap also has a first horizontally elongated flexible member having first and second opposite ends, each of which is aligned with the corresponding one of the first and second regions. The first member is disposed between the first and second lips and has a flat top surface and a downwardly depending extension which slidably engages the first lip. The extension in a horizontal plane defines a FIG. 8 with left hand and right hand sections. Each section has a hole of like shape and size as the first opening which extends upwardly through the member. One hole is sealed; the other hole is open.

The first member is manually slidable between a closed position at which the one hole seals off the first opening and an open position at which the other hole is aligned with the first opening.

A second flat horizontal member engages the second lip and is spaced above the first member. The second member has a second opening vertically aligned with the first opening.

In use, the cap is secured to the container and is held in a hand of the user in such manner that a finger of this hand can apply suitable pressure to the first member to move it into open or closed position.

In order to augment the ease of operation, the first member can be provided with first and second oppositely disposed cut out recesses adjacent but spaced from the holes which are disposed between both sections. These recesses each have the general shape of a V with a vertex directed inwardly between the holes. In addition, the first member can have first and second oppositely disposed slots, each of the slots being disposed adjacent the corresponding one of the first and second recesses and spaced from both holes. Each slot extends from one section to the other and conforms in shape to the corresponding one of the first and second recesses. As a consequence of employing these recesses and slots, the manually slidable positioning of the first member into either one of the closed or open position is accompanied by a snap action forcing the first member into the desired position, the snap action being produced by momentary deformation of the slots which automatically return to undeformed state.

BRIEF DESCRIPTION OF THE DRAWINGS

FIG. 1 is a perspective exploded view of a preferred embodiment of the invention.

FIG. 2 is a perspective view showing the structure of FIG. 1 in closed position.

FIG. 3 is a top view of the structure shown in FIG. 2.

FIG. 4 is a view similar to FIG. 3 but showing the structure in open position.

FIG. 5 is a vertical cross section taken along line 5—5 in FIG. 3.

FIG. 6 is a vertical cross section taken along line 6—6 in FIG. 4.

FIG. 7 is a vertical cross section taken along line 7—7 in FIG. 2.

FIG. 8 is a plan view of the upper surface of a member used in the structure shown in FIGS. 1–7.

FIG. 9 is a vertical side view of the member of FIG. 8.

FIG. 10 is a vertical cross section taken along line 10—10 in FIG. 8.

FIG. 11 is a plan view of the lower surface of the member of FIG. 8.

DETAILED DESCRIPTION OF PREFERRED EMBODIMENTS

Referring now to FIGS. 1–11, a cap entirely formed of plastic is adapted to be secured to an open end of a container. The cap includes a vertical hollow cylinder 20 provided with an open lower end adapted to be secured to the open end of the container and a closed upper end 22 with a small centrally disposed first opening 24 therein surrounded by a raised peripheral first lip 26. The cylinder upper end has a second raised peripheral lip 28 extending upwardly above the first lip, the second lip having first and second oppositely disposed cut out regions 30 communicating with the cylinder upper end.

A first horizontally elongated flexible member has first and second opposite ends each of which is aligned with the corresponding one of the first and second regions. The first member is slidably disposed between the first and second lips and has a flat top surface 32 and a downwardly depending extension 34 which slidably engages the first lip. The extension in a horizontal plane defines a FIG. 8 with left hand and right hand sections 36 and 38, each section having a hole of like shape and size as the first opening which extends upwardly through the member. One hole 40 is sealed, the other hole 42 being open. The first member is manually slidable between a closed position at which the one hole seals off the first opening and an open position at which the other hole is aligned with the first opening.

A second flat horizontal member 44 is engaged to the second lip via a recess 46 in the second lip and spaced above the first member, said second member having a second opening 48 vertically aligned with the first opening 24.

The first member has first and second oppositely disposed cut out recesses 50 adjacent but spaced from the holes which are disposed between both sections and which have the general shape of a V with vertices 52 directed inwardly between the holes. The first member has first and second oppositely disposed slots 54, each of the slots being disposed adjacent the corresponding one of the first and second recesses and spaced from both holes, each slot extending from one section to the other and conforming in shape to the corresponding one of the first and second recesses.

The manually slidable positioning of the first member into either one of the closed or open position is accompanied by a snap action forcing the first member into the desired position, the snap action being produced by momentary deformation of the slots which automatically return to undeformed state.

More particularly, the structural arrangements of the cap are such that the first member is either in open or closed position. There are no intermediate positions. When the member is in closed position, the member end remote from the closed hole must be pushed inward to move the member into open position. Similarly, when the member is in open position, the member end remote from the open hole must be pushed inward to move the member into closed position. In either situation, the inward pressure momentarily causes the portions of the slots adjacent the member end receiving the pressure to be squeezed together. Since the first member is flexible, these squeezed portions will immediately expand to return to normal unsqueezed position, producing the snap action.

The cylinder 20 has first and second oppositely disposed vertically elongated finger receiving areas 56, each area communicating with the corresponding one of the first and second regions 30. The second member is shaped as shown at 58 to provide finger access from each area to the corresponding end of the first member thus facilitating one hand operation of the cap when secured to a container.

While the invention has been described with particular reference to the preferred embodiment, the protection sought is to be limited only by the terms of the claims which follow.

What is claimed is:

1. A cap adapted to be secured to an open end of a container, said cap comprising:

a vertical hollow cylinder provided with an open lower end adapted to be secured to the open end of the container and a closed upper end with a small centrally disposed first opening therein surrounded by a raised peripheral first lip, the cylinder upper end having a second peripheral lip extending upwardly above the first lip, the second lip having first and second oppositely disposed cut out regions communicating with the cylinder upper end;

a first horizontally elongated flexible member having first and second opposite ends each of which is aligned with a corresponding one of the first and second regions, the first member being disposed between the first and second lips, the first member having a flat top surface and a downwardly depending extension which slidably engages the first lip, the extension in a horizontal plane defining a FIG. 8 with left hand and right hand sections, each section having a hole of like shape and size as the raised peripheral first lip, one hole being sealed, the other hole being open, the first member being manually slidable between a closed position at which the one hole seals off the first opening and an open position at which the other hole is aligned with the first opening; and a second flat horizontal member engaged to the second lip and spaced above the first member, said second member having a second opening vertically aligned with the first opening.

2. The cap of claim 1 wherein the first member has first and second oppositely disposed cut out recesses which have the general shape of a V with vertices directed inwardly between the holes, said first member having first and second oppositely disposed slots, each of the slots being disposed adjacent a corresponding one of the first and second recesses and spaced from both holes, each slot extending from one section to the other and conforming in shape to a corresponding one of the first and second recesses.

3. The cap of claim 2 wherein the manually slidable positioning of the first member into either one of the closed or open position is accompanied by a snap action forcing the first member into the desired position, the snap action being produced by momentary deformation of the extension which automatically returns to an undeformed state.

4. The cap of claim 3 wherein the cylinder has first and second oppositely disposed vertically elongated finger receiving areas, each area communicating with a corresponding one of the first and second regions.

5. The cap of claim 4 wherein the second member is shaped to provide finger access from each area to a corresponding end of the first member.

* * * * *